US010177467B1

(12) United States Patent
Blackburn et al.

(10) Patent No.: US 10,177,467 B1
(45) Date of Patent: Jan. 8, 2019

(54) CABLE CONNECTOR ASSEMBLY WITH BACKSHELL

(71) Applicant: TE CONNECTIVITY CORPORATION, Berwyn, PA (US)

(72) Inventors: Christopher William Blackburn, Harrisburg, PA (US); Richard Elof Hamner, Hummelstown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/710,918

(22) Filed: Sep. 21, 2017

(51) Int. Cl.
*H01R 4/48* (2006.01)
*H01R 13/00* (2006.01)
*H01R 13/504* (2006.01)

(52) U.S. Cl.
CPC ..... *H01R 4/48* (2013.01); *H01R 13/005* (2013.01); *H01R 13/504* (2013.01)

(58) Field of Classification Search
CPC ..... H01R 4/48; H01R 13/005; H01R 13/504
USPC ..... 439/353
See application file for complete search history.

(56) References Cited

U.S. PATENT DOCUMENTS 5,259,792 A * 11/1993 Beck ..... H01R 23/662 439/607.49
6,428,357 B1 * 8/2002 Dolinshek ..... H01R 43/18 29/856
6,506,077 B2 * 1/2003 Nagel ..... H01R 13/6474 439/418
6,808,410 B1 * 10/2004 Lee ..... H01R 12/592 439/484
6,830,472 B1 * 12/2004 Wu ..... H01R 13/6275 439/352
6,971,923 B1 * 12/2005 Wu ..... H01R 9/03 439/606
7,165,994 B2 * 1/2007 Ferry ..... H01R 29/00 439/607.34
7,175,479 B1 * 2/2007 McAlonis ..... H01R 13/6275 29/750
7,226,307 B1 * 6/2007 Chen ..... H01R 13/6275 439/352
7,261,582 B2 * 8/2007 Wu ..... H01R 13/506 439/352
7,322,845 B2 * 1/2008 Regnier ..... H01R 13/6275 439/352
7,393,218 B1 * 7/2008 Pavlovic ..... H01R 4/646 439/939
7,857,650 B1 * 12/2010 Wu ..... H01R 13/6275 439/352

(Continued)

*Primary Examiner* — Alexander Gilman

(57) ABSTRACT

A cable connector assembly includes an electrical connector and a backshell. The electrical connector includes a housing and electrical conductors held in the housing. The electrical conductors are terminated to a cable that extends from a cable end of the electrical connector. The backshell has an overmolded body and a latch assembly for removably coupling the cable connector assembly to one or more of a panel or a mating connector. The overmolded body is a unitary, one-piece body that surrounds the electrical connector around a full perimeter of the electrical connector. The latch assembly includes a latch frame and a latch member. The latch frame is embedded in the overmolded body. The latch member is held by the latch frame. The latch member includes a deflectable spring beam configured to engage the panel or the mating connector.

20 Claims, 4 Drawing Sheets

(56) References Cited

U.S. PATENT DOCUMENTS

| | | | | |
|---|---|---|---|---|
| 9,035,199 | B2 * | 5/2015 | Janota ..... | H05K 9/0007<br>174/355 |
| 9,343,838 | B2 | 5/2016 | Jove Albos | |
| 2003/0224649 | A1 * | 12/2003 | Vista, Jr. ..... | H01R 13/2428<br>439/449 |

* cited by examiner

CABLE CONNECTOR ASSEMBLY WITH BACKSHELL

BACKGROUND OF THE INVENTION

The subject matter herein relates generally to a cable connector assembly that includes a cable-mounted electrical connector and a backshell at least partially surrounding the connector.

Known backshells for cable-mounted electrical connectors are formed as at least two discrete shell members that are fastened together around the electrical connector. The shell members may be formed via die casting or computer-aided machining. The shell members may be fastened together using guide pins, screws, bolts, and/or the like.

The manufacturing and assembly process of known backshells have several disadvantages. For example, the shell members produced via the die casting process may have remnant portions that require post-processing to grind off the remnant portions prior to assembly. In addition, the assembly process may be relatively complex due to the multitude of guide pins and fasteners that may be utilized. The assembly process may also include the integration of gaskets at interfaces between the shell members and/or at the cable end of the backshell from which the cable protrudes. The gaskets are used for sealing openings and seams. If the backshell is not precisely assembled, one or more of the seals provided by the gaskets may fail, allowing electromagnetic interference (EMI) emissions to and from the electrical connector, which may interfere with the performance of the electrical connector and/or the performance of neighboring electrical connectors and other devices.

A need remains for a cable connector assembly with a backshell that provides efficient shielding for the electrical connector and an improved installation process than the backshells of known cable-mounted electrical connectors.

BRIEF DESCRIPTION OF THE INVENTION

In one or more embodiments, a cable connector assembly is provided that includes an electrical connector and a backshell. The electrical connector has a mating end and a cable end. The electrical connector includes a housing at the mating end and electrical conductors held in the housing. The electrical conductors are terminated to a cable that extends from the cable end of the electrical connector. The backshell has an overmolded body and a latch assembly for removably coupling the cable connector assembly to one or more of a panel or a mating connector. The overmolded body is a unitary, one-piece body that surrounds the electrical connector around a full perimeter of the electrical connector. The latch assembly includes a latch frame and a latch member. The latch frame is embedded in the overmolded body. The latch member is held by the latch frame. The latch member includes a deflectable spring beam configured to engage the panel or the mating connector.

In one or more embodiments, a cable connector assembly is provided that includes an electrical connector and a backshell. The electrical connector has a mating end and a cable end. The electrical connector includes a housing at the mating end and electrical conductors held in the housing. The electrical conductors are terminated to a cable that extends from the cable end of the electrical connector. The backshell has an overmolded body and a latch assembly for removably coupling the cable connector assembly to one or more of a panel or a mating connector. The overmolded body surrounds the housing. The latch assembly includes a latch frame and a latch member. The latch frame is disposed along an outer surface of the housing and is at least partially covered by the overmolded body to secure the latch frame in place. The latch frame defines a track. The latch member includes a base and a deflectable spring beam extending from the base. The base is slidably received within the track of the latch frame. The spring beam is configured to engage the panel or the mating connector.

In one or more embodiments, a cable connector assembly is provided that includes an electrical connector, a cable, and a backshell. The electrical connector has a mating end and a cable end. The electrical connector includes a housing at the mating end and electrical conductors held in the housing. The cable is terminated to the electrical conductors of the electrical connector. The cable extends from the cable end of the electrical connector. The backshell has an overmolded body and a latch assembly for removably coupling the cable connector assembly to one or more of a panel or a mating connector. The overmolded body is a unitary, one-piece body that is seamless and surrounds the electrical connector around a full perimeter of the electrical connector. The overmolded body protrudes beyond the cable end of the electrical connector and surrounds a segment of the cable outside of the electrical connector around a full perimeter of the cable. The latch assembly is partially embedded in the overmolded body. The latch assembly includes a deflectable spring beam configured to engage the panel or the mating connector.

DETAILED DESCRIPTION OF THE INVENTION

Figure 1:
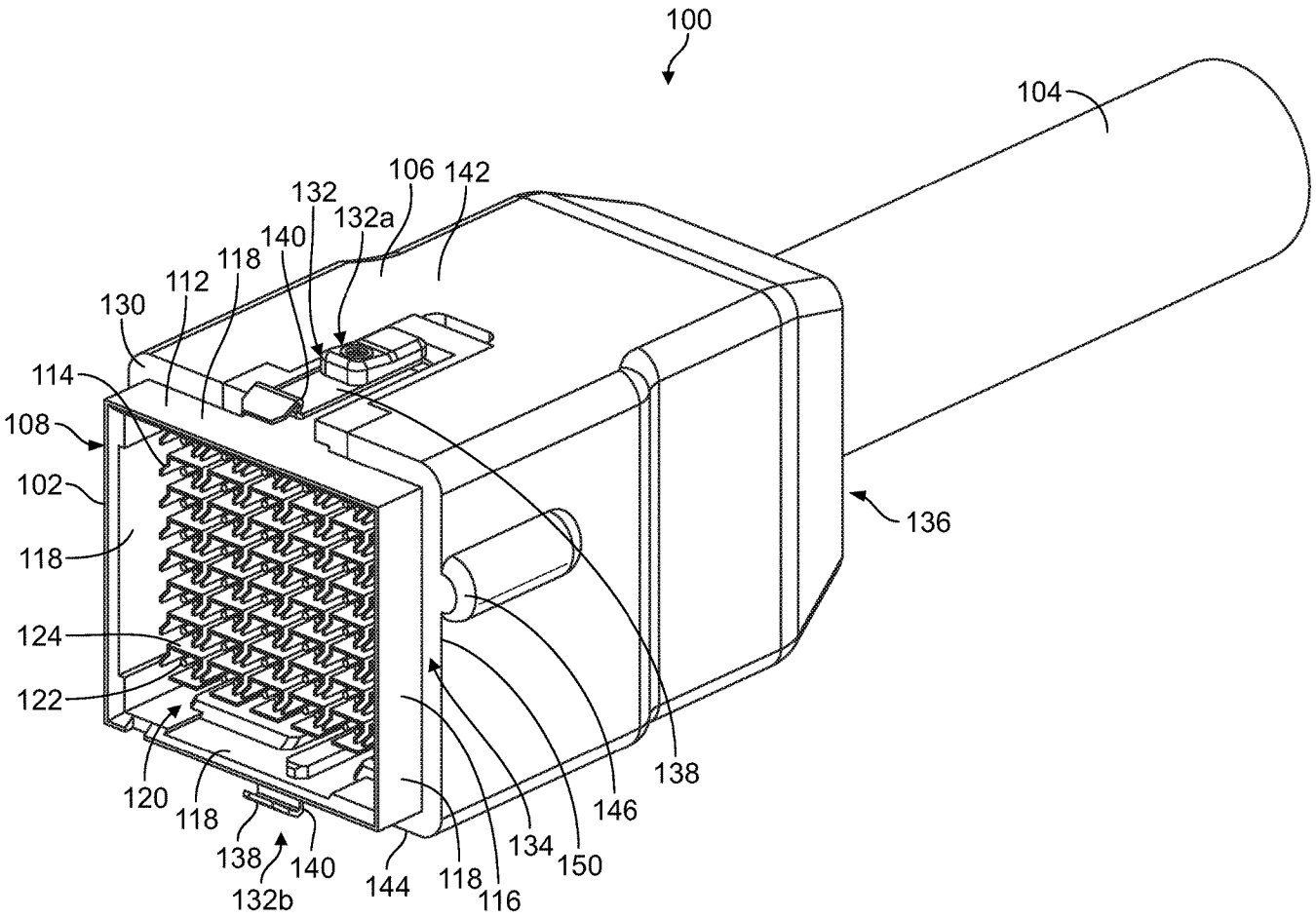
FIG. 1 is a perspective view of a cable connector assembly according to an embodiment.

FIG. 1 is a perspective view of a cable connector assembly 100 according to an embodiment. The cable connector assembly 100 includes an electrical connector 102, an electrical cable 104, and a backshell 106. The electrical connector 102 is electrically connected to the cable 104. The backshell 106 surrounds the electrical connector 102. The electrical connector 102 is configured to removably mate to a mating connector (not shown) to establish a conductive signal pathway between the electrical connector 102 and the mating connector. The cable connector assembly 100 is used to convey electrical signals and/or power between a first device (not shown), which is electrically connected to a distal end (not shown) of the cable 104, and a second device (not shown) that is electrically connected to the mating connector that mates to the electrical connector 102. The first and second devices may each be a circuit board (e.g., daughter board, backplane board, or the like) or another electrical device.

Figure 2:
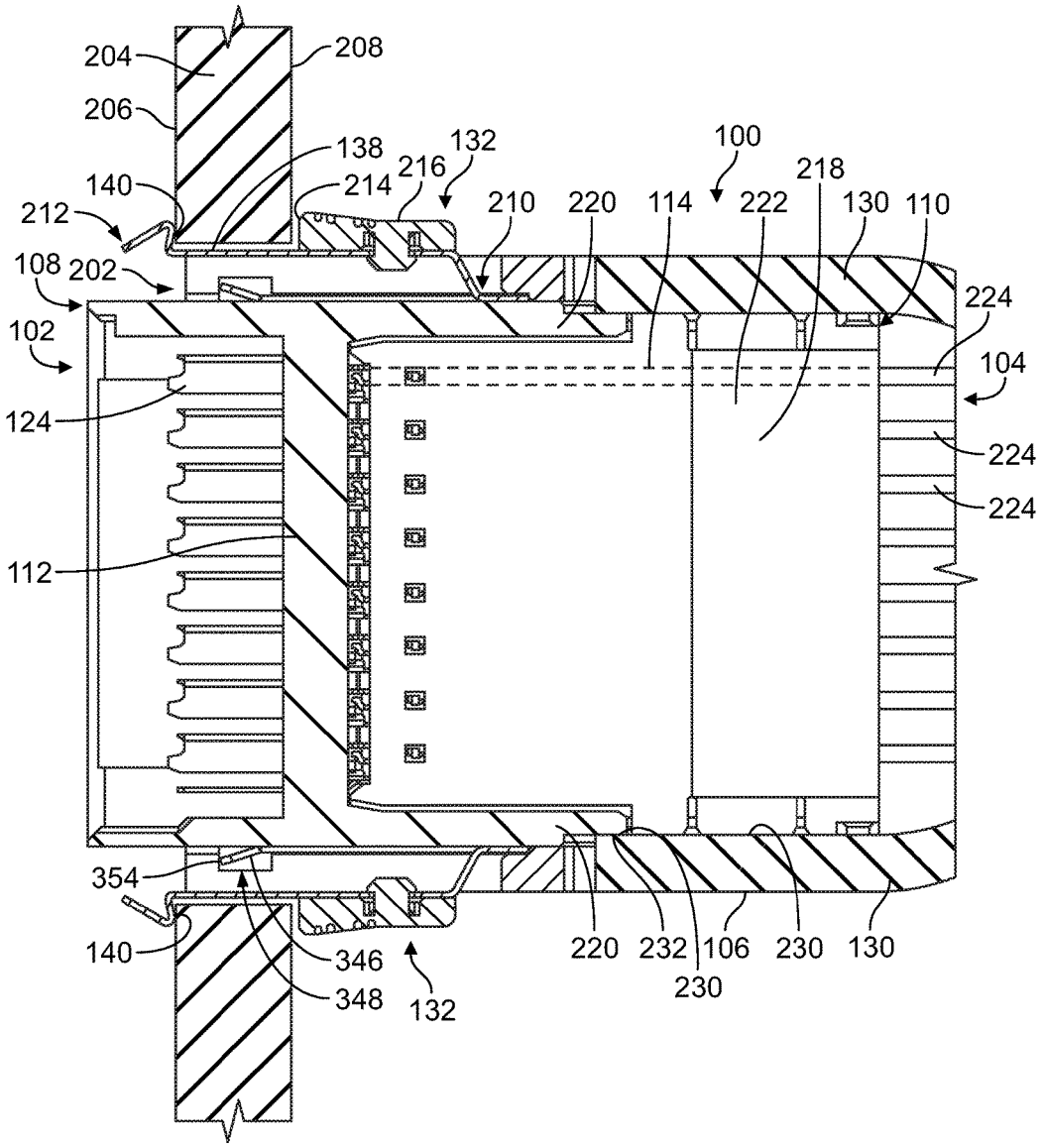
FIG. 2 is a side cross-sectional view of the cable connector assembly mounted within an opening of a panel according to an embodiment.

The electrical connector 102 has a mating end 108 and a cable end 110 (shown in FIG. 2). The electrical connector 102 includes a housing 112 and electrical conductors 114 held in the housing 112. The housing 112 is composed of a dielectric material, such as one or more plastics or other polymeric materials. The housing 112 defines the mating end 108 of the connector 102. The electrical conductors 114 are terminated (e.g., electrically connected and mechanically secured) to corresponding wires or sub-cables within the cable 104.

The illustrated electrical connector 102 is a header or plug connector that is configured to mate to a mating receptacle connector, but the electrical connector 102 in alternative embodiments may be a receptacle connector or a different type of electrical connector. The following description of the electrical connector 102 in FIG. 1 is therefore provided for illustration, rather than limitation, and is but one potential embodiment of the electrical connector 102 of the cable connector assembly 100.

The housing 112 includes a mating shroud 116 that extends to the mating end 108 of the electrical connector 102. The mating shroud 116 includes four walls 118 that define a perimeter of a connection chamber 120. The mating shroud 116 receives the mating receptacle connector into the connection chamber 120 during a mating operation. The conductors 114 of the electrical connector 102 include signal contacts 122 and ground contacts 124. The signal and ground contacts 122, 124 extend into the connection chamber 120 and are arranged in a grid array. The signal and ground contacts 122, 124 are freestanding within the connection chamber 120. In the illustrated embodiment, the ground contacts 124 are C-shaped ground shields that surround a corresponding single signal contact 122 or pair of signal contacts 122 on three sides thereof. The ground contacts 124 may have other shapes in other embodiments. When the mating receptacle connector is loaded into the connection chamber 120, the signal contacts 122 and the ground contacts 124 may be received into corresponding contact cavities (not shown) along a mating face of the receptacle connector to engage mating contacts of the receptacle connector within the contact cavities.

The backshell 106 has an overmolded body 130 and at least one integrated latch assembly 132. The overmolded body 130 has a first end 134 and a second end 136. The overmolded body 130 surrounds the electrical connector 102 along at least a portion of the length of the connector 102 between the mating end 108 and the cable end 110 (FIG. 2). The first end 134 of the overmolded body 130 is located at or proximate to the mating end 108, and the second end 136 is located at or proximate to the cable end 110. In the illustrated embodiment, the mating end 108 of the electrical connector 102 protrudes beyond the first end 134 of the overmolded body 130, such that a length of the mating shroud 116 is exposed beyond the first end 134.

The latch assembly 132 is integrated into the overmolded body 130. For example, a portion of the latch assembly 132 may be covered by or embedded within the overmolded body 130. The backshell 106 includes two latch assemblies 132*a*, 132*b* in the illustrated embodiment, but may have only one latch assembly 132 or more than two latch assemblies 132 in other embodiments. The two latch assemblies 132*a*, 132*b* are located along opposite top and bottom sides 142, 144 of the cable connector assembly 100 in the illustrated embodiment, although only a portion of the latch assembly 132*b* is visible in FIG. 1. The latch assemblies 132*a*, 132*b* may be identical, such that the latch assembly 132 in the following description applies to both latch assemblies 132*a*, 132*b*.

The latch assembly 132 is configured to removably couple the cable connector assembly 100 to a panel and/or a mating connector. For example, the cable connector assembly 100 may be configured to extend through an opening in a panel, and the latch assembly 132 may engage the wall around the opening to secure the cable connector assembly 100 to the panel. Alternatively, the latch assembly 132 may be used to releasably lock the electrical connector 102 to the mating connector, prohibiting unintentional disconnection. The latch assembly 132 includes a deflectable spring beam 138 with a catch surface 140 that mechanically engages the panel and/or the mating connector. In the illustrated embodiment, the latch assembly 132 is located along the first end 134 of the overmolded body 130, but the latch assembly 132 may be spaced apart from the first end 134 in an alternative embodiment.

The overmolded body 130 optionally includes one or more keying features 146 that protrude from one or more planar sides of the overmolded body 130. A single keying feature 146 is visible in FIG. 1. The keying feature 146 is located off-center along a length of the respective side 150 of the overmolded body 130. As the cable connector assembly 100 is loaded into the opening of the panel or into the receptacle mating connector, the keying feature 146 is configured to restrict loading of the cable connector assembly 100 to one permissible orientation by stubbing on the panel and/or the mating connector in all other orientations.

FIG. 2 is a side cross-sectional view of the cable connector assembly 100 mounted within an opening 202 of a panel 204 according to an embodiment. The panel 204 has a first side 206 and a second side 208 that is opposite to the first side 206. The cable connector assembly 100 is mounted to the panel 204 such that the mating end 108 of the electrical connector 102 protrudes beyond the first side 206, and the cable end 110 of the electrical connector 102 is disposed beyond the second side 208.

The spring beams 138 of the latch assemblies 132 engage the panel 204. For example, each spring beam 138 is cantilevered and extends from a fixed end 210 to a distal free end 212. The fixed end 210 is secured in place, and the distal free end 212 is movable. The catch surface 140 is located proximate to the distal free end 212. In the illustrated embodiment, the spring beams 138 extend through the opening 202. The fixed ends 210 are located beyond the second side 208, and the catch surfaces 140 are located beyond the first side 206. The catch surfaces 140 are configured to engage the first side 206 of the panel 204. The cable connector assembly 100 is retained within the opening 202 by sandwiching the panel 204 between the catch surfaces 140 of the spring beams 138 and hard stop surfaces that are configured to engage the second side 208. In the illustrated embodiment, the hard stop surfaces are represented by the first end 134 of the overmolded body 130 (FIG. 1). For example, the overmolded body 130 may be electrically conductive such that the engagement between the overmolded body 130 and the panel 204 provides a conductive ground path between the cable connector assembly 100 and the panel 204. In other embodiments, the hard stop surfaces may be tabs protruding from an exterior surface 406 (shown in FIG. 4) of the overmolded body 130, the front ends 214 of release buttons 216 that are mounted on the spring beams 138, or a different portion of the latch assembly 132.

In the illustrated embodiment, the electrical connector 102 includes a plurality of cable modules 218 (e.g., cable module assemblies or "cablets") that are individually loaded into the housing 112. Only one cable module 218 is visible in the cross-sectional view of FIG. 2. Multiple cable modules 218 may be stacked side by side along a lateral width of the housing 112. The cable modules 218 collectively define the cable end 110 of the electrical connector 102. The cable modules 218 are held in place by the housing 112. For example, the cable modules 218 may be secured between two hoods 220 of the housing 112. Each of the cable modules 218 includes a plurality of conductors 114 and a dielectric body 222. The dielectric body 222 holds the conductors 114 in place and prevents adjacent conductors 114 from engaging each other. In the illustrated embodiment, the conductors 114 of the cable module 218 are held in a linear column. The conductors 114 extend through the dielectric body 222 from the signal contacts 122 (shown in FIG. 1) and ground contacts 124 in the housing 112 towards the cable end 110. The conductors 114 are electrically terminated to insulated wires or sub-cables 224 of the cable 104. One of the conductors 114 is traced in phantom in FIG. 2.

Although the electrical connector 102 in the illustrated embodiment includes multiple cable modules 218 stacked together, the electrical connector 102 in other embodiments may not have a stack of cable modules. For example, the housing 112 may be configured to hold the conductors 114 in place or the connector 102 may include a dielectric holder within the housing 112 that holds all of the conductors 114.

In the illustrated embodiment, the electrical connector 102 is an in-line connector as the mating end 108 is oriented substantially parallel to the cable end 110 and the conductors 114 extend generally linearly therebetween. In an alternative embodiment, the electrical connector 102 may have a different orientation. For example, the connector 102 may be a right angle connector in which the mating end 108 is oriented substantially perpendicularly to the cable end 110.

The sub-cables 224 of the cable 104 extend from the cable end 110 of the connector 102. The sub-cables 224 may be twin-axial cables, co-axial cables, or the like. The cable 104 may include a plurality of sub-cables 224 collectively surrounded by a cable jacket (not shown). The electrical connector 102 optionally includes conductive shields (not shown) mounted to sides of the dielectric bodies 222 between adjacent cable modules 218.

In an embodiment, the overmolded body 130 of the backshell 106 protrudes beyond the cable end 110 of the electrical connector 102 and surrounds a segment of the cable 104 outside of the connector 102. FIG. 2 shows that the overmolded body 130 surrounds the sub-cables 224 that protrude from the cable end 110.

With additional reference to FIG. 1, the overmolded body 130 of the backshell 106 in one or more embodiments is a unitary, one-piece body that surrounds the electrical connector 102 around a full perimeter of the connector 102. The overmolded body 130 therefore wraps an entire 360 degrees around the perimeter of the connector 102, like a sleeve or tube. The overmolded body 130 also surrounds the segment of the cable 104 near the cable end 110 around a full perimeter of the cable 104.

In one or more embodiments, the overmolded body 130 is overmolded on the electrical connector 102 and the cable 104. For example, the overmolded body 130 is formed in situ on the electrical connector 102 and the cable 104. The overmolded body 130 includes at least one dielectric polymeric material, such as a resin or epoxy, that is applied onto the electrical connector 102 and the cable 104 in a flowable, liquid state and allowed to set and solidify to form the overmolded body 130. In an embodiment, the electrical connector 102 is electrically terminated to the cable 104 prior to application of the flowable material of the overmolded body 130. Since the overmolded body 130 is formed in situ on the electrical connector 102, the overmolded body 130 may be seamless. In addition, an interior surface 230 of the overmolded body 130 may engage an outer surface 232 of the housing 112 around substantially the entire perimeter of the housing 112. The flowable polymeric material of the overmolded body 130 flows into voids and along protrusions of the electrical connector 102 along the perimeter of the housing 112 and the cable modules 218. The contour of the interior surface 230 of the overmolded body 130 therefore corresponds to the contour of the connector 102 along the perimeter thereof.

In an embodiment, the overmolded body 130 is electrically conductive and is used as a grounding structure. For example, the overmolded body 130 may provide a ground path from the electrical connector 102 and the cable 104 to the panel 204. In one embodiment, the overmolded body 130 is formed of an electrically-conductive polymer material. For example, the material may be an intrinsically conducting polymer (ICP) material, a dielectric material impregnated with metal particles, or the like. The electrically-conductive polymer material is moldable and has conductive properties without requiring a discrete metal layer. In another embodiment, the overmolded body 130 is electrically conductive by applying a metal plating layer onto a dielectric polymeric material of the overmolded body 130. For example, the dielectric material, such as a resin, epoxy, plastic, or the like, may be overmolded onto the electrical connector 102, and then the metal plating layer is applied onto the outer surface of the dielectric material. The metal plating layer may be or include nickel, copper, phosphorus, silver, or the like. In yet another embodiment, the electrical connector 102 may be shielded using a conductive tape or metal foil. For example, the conductive tape or metal foil may be wrapped around the connector 102 and the end of the cable 104 prior to molding the overmolded body 130, such that the tape or foil is under the body 130. Alternatively, the tape or metal foil may be integrated within a thickness of the overmolded body 130 or disposed along the exterior surface 406 (shown in FIG. 4) of the body 130.

Figure 3:
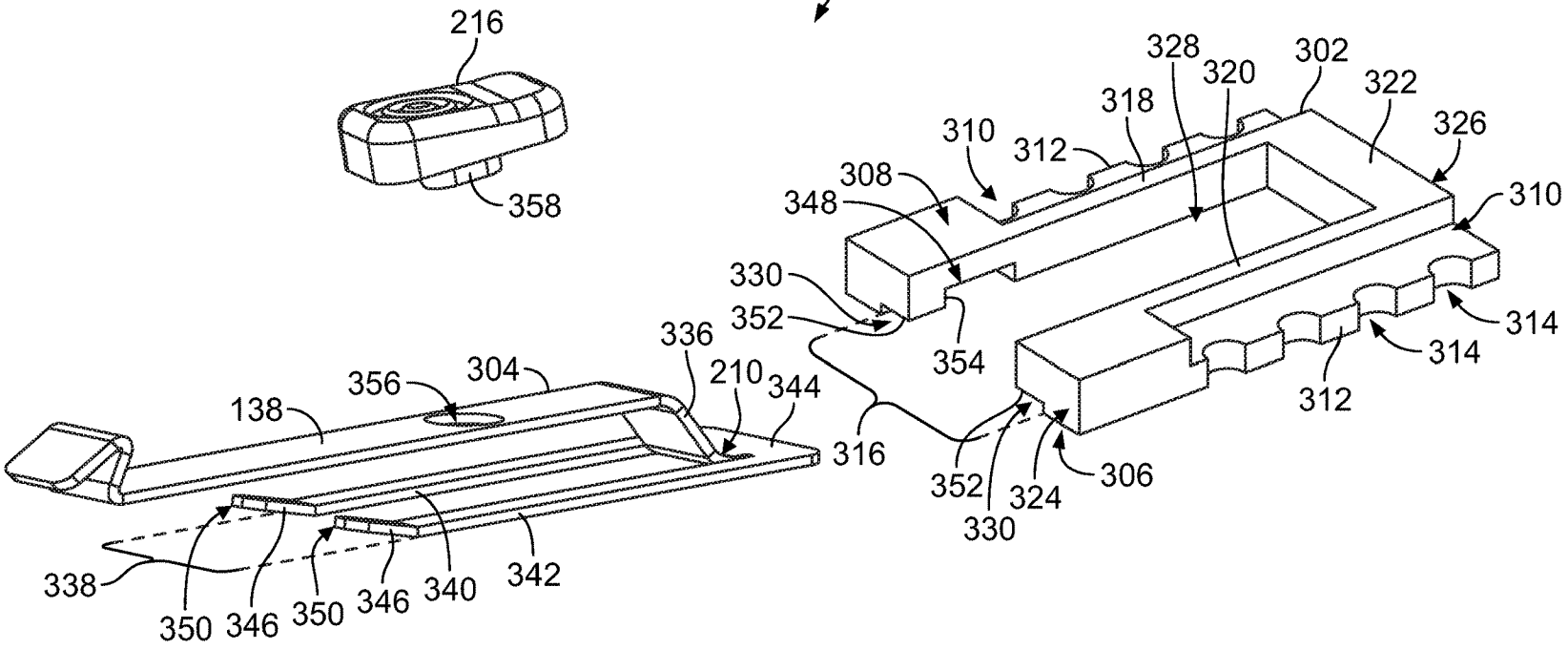
FIG. 3 is an exploded perspective view of a latch assembly of a backshell of the cable connector assembly according to an embodiment.

FIG. 3 is an exploded perspective view of the latch assembly 132 of the backshell 106 of the cable connector assembly 100 according to an embodiment. The latch assembly 132 in the illustrated embodiment includes a latch frame 302, a latch member 304, and the release button 216.

The latch frame 302 has an interior side 306 and an exterior side 308 that is opposite the interior side 306. The latch frame 302 is oriented relative to the cable connector assembly 100 such that the interior side 306 faces the housing 112 (FIG. 2). The latch frame 302 is configured to be secured to the cable connector assembly 100 via the overmolded body 130 of the backshell 106 (FIG. 2). For example, the latch frame 302 may be at least partially covered by or embedded within the overmolded body 130 during the formation of the overmolded body 130. The latch frame 302 in the illustrated embodiment includes cutout portions 310 along the exterior side 308 and serrated edges 312. The overmolded body 130 in the flowable state may be applied within the cutout portions 310, covering the serrated edges 312. The overmolded body 130 also enters the small grooves (e.g., serrations) 314 along the serrated edges 312, which increases the contact surface area between the overmolded body 130 and the latch frame 302 (relative to planar edges). As the flowable material of the overmolded body 130 sets and solidifies, the latch frame 302 is embedded within and partially covered by the overmolded body 130.

The latch frame 302 couples to the latch member 304 to hold the latch member 304 onto the cable connector assembly 100. For example, the latch frame 302 defines a track 316 that receives the latch member 304 therein. In the illustrated embodiment, the track 316 is defined along the interior side 306 of the latch frame 302, but the track 316 may be spaced apart from the interior side 306 in an alternative embodiment.

In an embodiment, the latch frame 302 includes first and second frame members 318, 320 and a bridge 322 that extends between and connects the frame members 318, 320. The latch frame 302 extends between a first end 324 and a second end 326. The bridge 322 is disposed at the second end 326. The track 316 is open along the first end 324 and is configured to receive the latch member 304 through the first end 324. The track 316 is closed along the second end 326 as the bridge 322 defines a back end of the track 316. The first and second frame members 318, 320 extend parallel to each other from the bridge 322 to the first end 324. The frame members 318, 320 are spaced apart from each other to define an open cavity 328.

In the illustrated embodiment, each of the first and second frame members 318, 320 includes a respective slot 330 that defines a portion of the track 316. The slots 330 extend from the first end 324 to the bridge 322. The bridge 322 optionally also includes a slot 332 (shown in FIG. 5) that defines a portion of the track 316. In an embodiment, the slot 332 does not extend fully through the bridge 322 to the second end 326, as the bridge 322 includes a shoulder 334 (FIG. 5) that defines the back end of the slot 332 and the track 316. As described above, the slots 330, 332 are defined along the interior side 306 in the illustrated embodiment, but may be spaced apart from the interior side 306 in an alternative embodiment.

The latch member 304 includes a base 338 and the spring beam 138, which extends from the base 338. The fixed end 210 of the spring beam 138 is at the base 338. The spring beam 138 is suspended above a plane of the base 338 by a transition segment 336 of the spring beam 138 that extends along an S-shaped or Z-shaped curve from the fixed end 210. In an embodiment, the spring beam 138 is integrally connected to the base 338. For example, the latch member 304 may be stamped and formed out of a single sheet of metal with the spring beam 138 being bent out of the plane of the base 338 during the formation step. The spring beam 138 in the illustrated embodiment defines a mounting hole 356 therethrough. The mounting hole 356 is configured to receive a plunger bulb 358 of the release button 216 therein to mount the release button 216 to the spring beam 138.

The base 338 has first and second legs 340, 342. The spring beam 138 is disposed laterally between the legs 340, 342, although it is suspended vertically above the legs 340, 342. The base 338 has a lateral bar 344 from which both legs 340, 342 and the spring beam 138 extend. The base 338 of the latch member 304 is slidably received within the track 316 of the latch frame 302 and is secured within the track 316 to couple the latch member 304 to the latch frame 302. The first and second legs 340, 342 of the base 338 are each received in a corresponding one of the slots 330 of the first and second frame members 318, 320 through the first end 324 of the latch frame 302. For example, the first leg 340 is received within the slot 330 of the first frame member 318, and the second leg 342 is received within the slot 330 of the second frame member 320. The spring beam 138 aligns with the cavity 328 of the latch frame 302.

In an embodiment, the base 338 of the latch member 304 is secured within the track 316 of the latch frame 302 via the reception of deflectable bent tabs 346 of the legs 340, 342 into corresponding pockets 348 of the frame members 318, 320. The bent tabs 346 are located at distal ends 350 of the legs 340, 342 (e.g., opposite the lateral bar 344) in the illustrated embodiment. In an alternative embodiment, the bent tabs 346 may be spaced apart from the distal ends 350. The bent tabs 346 extend vertically out of the plane of the base 338 towards the suspended spring beam 138, and resemble the sloped tips of skis. The pockets 348 of the frame members 318, 320 are spaced apart from the first end 324 of the latch frame 302. Only the pocket 348 of the first frame member 318 is visible in FIG. 3. Each of the pockets 348 is open (e.g., fluidly connected) to the corresponding slot 330, and extends from the slot 330 towards the exterior side 308 of the latch frame 302.

As the legs 340, 342 are slidably received within the corresponding slots 330, each of the bent tabs 346 initially abuts a ceiling 352 of the respective slot 330, which deflects the bent tab 346 downward (e.g., towards the electrical connector 102 shown in FIG. 2). In response to the latch member 304 reaching a fully loaded position within the latch frame 302, the bent tabs 346 align with the corresponding pockets 348 and resile from the deflected position towards an undeflected position in which the bent tabs 346 enter the pockets 348. As shown in FIG. 2, engagement between the bent tabs 346 and front walls 354 of the pockets 348 blocks the latch member 304 from sliding out of the latch frame 302 through the first end 324. The front walls 354 are located proximate to the first end 324 of the latch frame 302, and face towards the second end 326.

Figure 4:
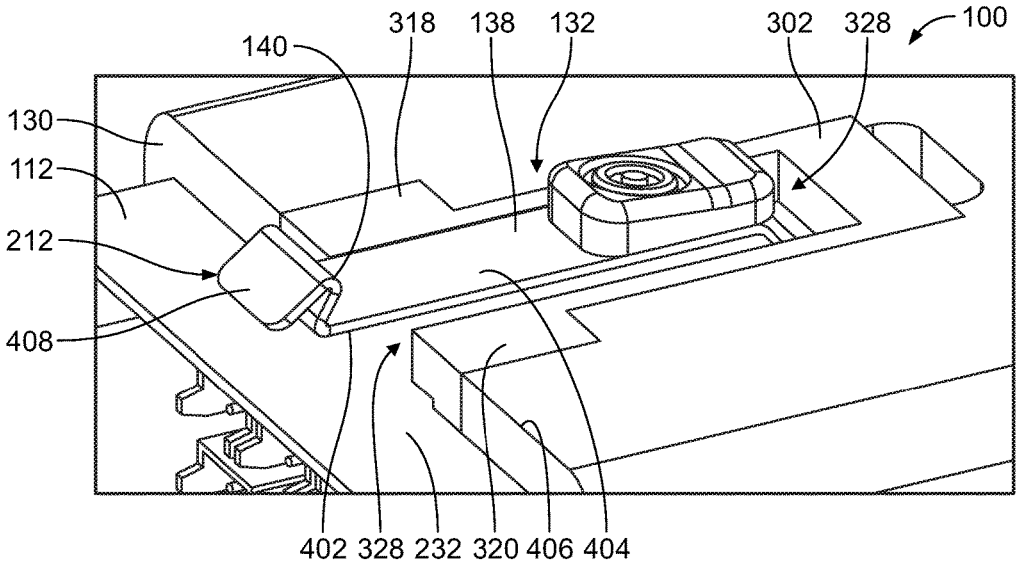
FIG. 4 is a perspective view of a portion of the cable connector assembly showing the latch assembly according to an embodiment.

FIG. 4 is a perspective view of a portion of the cable connector assembly 100 showing the latch assembly 132 according to an embodiment. When the latch assembly 132 is assembled, the spring beam 138 aligns with the cavity 328 of the latch frame 302 between the two frame members 318, 320. The spring beam 138 is suspended above (e.g., outward of) the outer surface 232 of the housing 112. The spring beam 138 has an inner side 402 facing the housing 112 and an outer side 404 that is opposite the inner side 402. The catch surface 140 extends outward beyond the outer side 404 of the spring beam 138. For example, the catch surface 140 projects beyond an exterior surface 406 of the overmolded body 130 in order to engage the panel 204 (shown in FIG. 2), or the mating connector, at a location that is outward of the overmolded body 130. The catch surface 140 is located proximate to the distal free end 212 of the spring beam 138.

The spring beam 138 includes a ramp surface 408 extending from the distal free end 212 to the catch surface 140. As shown in FIG. 2, the ramp surface 408 is configured to engage an edge of the second side 208 of the panel 204 as the cable connector assembly 100 is loaded into the opening 202 towards the first side 206. The ramp surface 408 has a slope that allows the spring beam 138 to deflect downwards (e.g., inward) towards the outer surface 232 of the housing 112 as the cable connector assembly 100 is loaded through the opening 202 without stubbing on the second side 208 of the panel 204.

Figure 5:
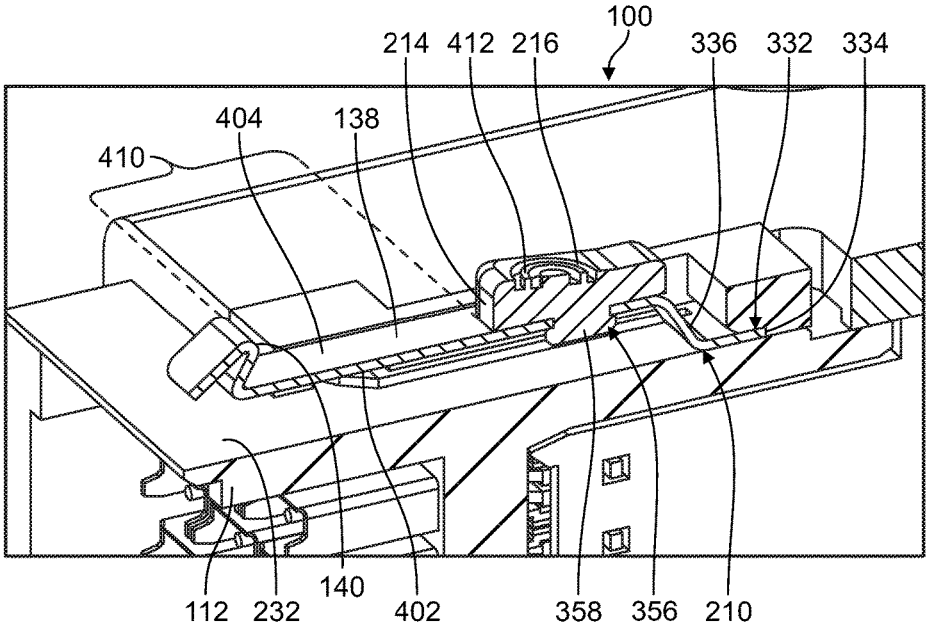
FIG. 5 is a transverse cross-sectional view of the portion of the cable connector assembly shown in FIG. 4 according to an embodiment.

FIG. 5 is a transverse cross-sectional view of the portion of the cable connector assembly 100 shown in FIG. 4 according to an embodiment. The release button 216 is mounted to the spring beam 138 between the fixed end 210 and the catch surface 140. The plunger bulb 358 of the release button 216 extends through the mounting hole 356 from the outer side 404 and protrudes beyond the inner side 402. The plunger bulb 358 may be compressible with a larger size than the mounting hole 356, such that the plunger bulb 358 secures the release button 216 to the spring beam 138 via a press fit engagement.

The release button 216 is spaced apart from the catch surface 140 to define a space 410 between the front end 214 of the release button 216 and the catch surface 140 that accommodates the thickness of the panel 204 (shown in FIG. 2). The mounting location of the release button 216 is also spaced apart from the fixed end 210 and the transition segment 336 of the spring beam 138. When a person (e.g., an operator) presses on an outer surface 412 of the release button 216, the cantilevered spring beam 138 flexes and the catch surface 140 moves towards the outer surface 232 of the housing 112 until the pressing force is removed and the spring beam 138 is allowed to resile towards the resting position of the spring beam 138 illustrated in FIG. 5. The release button 216 allows the operator to selectively uncouple the spring beam 138 from the panel 204 to remove the cable connector assembly 100 from the panel 204. The discrete release button 216 shown in FIGS. 3-5 is optional. For example, in one alternative embodiment the release button may be an integral raised bump along the spring beam 138. In another embodiment, there is no release button, and the operator presses on the spring beam 138 at a location between the panel 204 and the transition segment 336 to depress the spring beam 138 for removing the cable connector assembly 100 from the panel 204.

While various spatial and directional terms, such as "top," "bottom," "upper," "lower," "vertical," and the like may be used to describe embodiments of the present disclosure, it is understood that such terms are merely used with respect to the orientations shown in the drawings. The orientations may be inverted, rotated, or otherwise changed, such that the top side 142 becomes a bottom side if the cable connector assembly 100 is flipped 180 degrees, becomes a left side or a right side if the cable connector assembly 100 is pivoted 90 degrees, and the like.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely example embodiments. Many other embodiments and modifications within the spirit and scope of the claims will be apparent to those of ordinary skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A cable connector assembly comprising:

an electrical connector having a mating end and a cable end, the electrical connector including a housing at the mating end and electrical conductors held in the housing, the electrical conductors terminated to a cable that extends from the cable end of the electrical connector; and a backshell having an overmolded body and a latch assembly for removably coupling the cable connector assembly to one or more of a panel or a mating connector, the overmolded body being a unitary, one-piece body that surrounds the electrical connector around a full perimeter of the electrical connector, the latch assembly including a latch frame and a latch member that is discrete from the latch frame, the latch frame embedded in and at least partially covered by the overmolded body to secure the latch frame in place, the latch member coupled to the latch frame to hold the latch member onto the cable connector assembly, the latch member including a deflectable spring beam configured to engage the one or more of the panel or the mating connector.

2. The cable connector assembly of claim 1, wherein the overmolded body of the backshell protrudes beyond the cable end of the electrical connector to surround a segment of the cable outside of the electrical connector around a full perimeter of the cable.

3. The cable connector assembly of claim 1, wherein the overmolded body includes an electrically-conductive polymer material.

4. The cable connector assembly of claim 1, wherein the overmolded body includes a dielectric polymeric material and a metal plating layer disposed on the dielectric polymeric material.

5. The cable connector assembly of claim 1, wherein the overmolded body is seamless.

6. The cable connector assembly of claim 1, wherein the overmolded body has a first end and a second end, wherein the housing at the mating end of the electrical connector protrudes beyond the first end of the overmolded body.

7. The cable connector assembly of claim 1, wherein the latch frame includes first and second frame members, each of the first and second frame members defining a respective slot, the latch member including a base connected to the spring beam, the base having first and second legs that are each slidably received within a different corresponding slot of the first and second frame members.

8. The cable connector assembly of claim 7, wherein each of the first and second frame members defines a pocket fluidly connected to the respective slot, wherein each of the first and second legs of the latch member has a bent tab that is received within the pocket of the corresponding frame member responsive to the latch member reaching a fully loaded position relative to the latch frame.

9. The cable connector assembly of claim 1, wherein the spring beam of the latch member includes an inner side that faces the housing of the electrical connector and an outer side that is opposite the inner side, the spring beam of the latch member extending from a fixed end to a distal free end, the spring beam including a catch surface disposed outward of the outer side and a ramp surface extending from the distal free end to the catch surface.

10. The cable connector assembly of claim 1, wherein the spring beam of the latch member extends from a fixed end to a distal free end, the spring beam including a catch surface located proximate to the distal free end and a release button mounted to the spring beam between the fixed end and the catch surface, the release button spaced apart from the catch surface.

11. The cable connector assembly of claim 1, wherein the latch frame defines a track and the latch member is slidably received within the track of the latch frame to couple the latch member to the latch frame.

12. A cable connector assembly comprising:

an electrical connector having a mating end and a cable end, the electrical connector including a housing at the mating end and electrical conductors held in the housing, the electrical conductors terminated to a cable that extends from the cable end of the electrical connector; and a backshell having an overmolded body and a latch assembly for removably coupling the cable connector assembly to one or more of a panel or a mating connector, the overmolded body surrounding the housing, the latch assembly including a latch frame and a latch member, the latch frame disposed along an outer surface of the housing and at least partially covered by the overmolded body to secure the latch frame in place, the latch frame defining a track, the latch member including a base and a deflectable spring beam extending from the base, the base slidably received within the track of the latch frame, the spring beam configured to engage the one or more of the panel or the mating connector.

13. The cable connector assembly of claim 12, wherein the latch frame includes first and second frame members that are spaced apart from each other by a cavity of the latch frame, the first and second frame members defining respective slots that represent portions of the track, the base of the latch member having first and second legs that are slidably received within the slots of the first and second frame members, the spring beam disposed laterally between the first and second legs and aligning with the cavity of the latch frame.

14. The cable connector assembly of claim 12, wherein the track is defined by at least one slot in the latch frame along an interior side of the latch frame that faces the outer surface of the housing, the latch frame defining at least one pocket fluidly connected to the at least one slot, the base of the latch member including at least one bent tab that enters the at least one pocket responsive to the latch member reaching a fully loaded position relative to the latch frame.

15. The cable connector assembly of claim 12, wherein the overmolded body is a unitary, one-piece body that is seamless and surrounds the electrical connector around a full perimeter of the electrical connector.

16. The cable connector assembly of claim 12, wherein the spring beam of the latch member extends from a fixed end to a distal free end, the spring beam including a catch surface located proximate to the distal free end and a release button mounted to the spring beam between the fixed end and the catch surface, the release button spaced apart from the catch surface.

17. A cable connector assembly comprising:

an electrical connector having a mating end and a cable end, the electrical connector including a housing at the mating end and electrical conductors held in the housing;

a cable terminated to the electrical conductors of the electrical connector, the cable extending from the cable end of the electrical connector; and a backshell having an overmolded body and a latch assembly for removably coupling the cable connector assembly to one or more of a panel or a mating connector, the overmolded body being a unitary, one-piece body that is seamless and surrounds the electrical connector around a full perimeter of the electrical connector, the overmolded body protruding beyond the cable end of the electrical connector and surrounding a segment of the cable outside of the electrical connector around a full perimeter of the cable, the latch assembly including a latch frame and a latch member, the latch frame defining a track, the latch member slidably received within the track to couple the latch member to the latch frame, the latch member including a deflectable spring beam configured to engage the one or more of the panel or the mating connector.

18. The cable connector assembly of claim 17, wherein the overmolded body includes an electrically-conductive polymer material.

19. The cable connector assembly of claim 17, wherein the overmolded body includes a dielectric polymeric material and a metal plating layer disposed on the dielectric polymeric material.

20. The cable connector assembly of claim 17, wherein the latch frame is embedded in and at least partially covered by the overmolded body, the latch frame including first and second frame members that are spaced apart from each other by a cavity of the latch frame, the spring beam of the latch member suspended within the cavity.

* * * * *